US006050077A

United States Patent [19]

Müller

[11] Patent Number: 6,050,077

[45] Date of Patent: Apr. 18, 2000

[54] SAFETY MOUNTAINEERING ROPE

[76] Inventor: Kurt Müller, Hirschparkweg 12, CH-4800 Zofingen, Switzerland

[21] Appl. No.: 09/115,225

[22] Filed: Jul. 14, 1998

[30] Foreign Application Priority Data

Jul. 17, 1997 [CH] Switzerland ..... 1756/97

[51] Int. Cl.[7] ..... D02G 3/02

[52] U.S. Cl. ..... 57/210; 57/225; 57/235; 57/231

[58] Field of Search ..... 57/210, 225, 231, 57/235

[56] References Cited

U.S. PATENT DOCUMENTS

| | | | |
|---|---|---|---|
| 2,101,003 | 11/1937 | Fox | 117/57 |
| 2,101,004 | 11/1937 | Fox | 117/57 |
| 2,175,389 | 10/1939 | Hanff | 174/113 |
| 3,486,409 | 12/1969 | Powell | 87/6 |
| 4,022,010 | 5/1977 | Gladenbeck et al. | 57/149 |
| 4,534,262 | 8/1985 | Swenson | 87/6 |
| 4,640,178 | 2/1987 | Kurzbock | 87/6 |
| 4,975,543 | 12/1990 | Saunders | 174/69 |
| 5,605,035 | 2/1997 | Pethrick et al. | 57/200 |

FOREIGN PATENT DOCUMENTS

| | | |
|---|---|---|
| 2402736 | 4/1979 | France . |
| 1481606 | 8/1977 | United Kingdom . |

*Primary Examiner*—William Stryjewski
*Attorney, Agent, or Firm*—Pillsbury Madison & Sutro

[57] ABSTRACT

The safety mountaineering rope (1) has a core comprising a plurality of core ropes (2).

In order to improve the tearing resistance of the rope (1), the rope core surrounds in the manner of a tube at least one cavity (3) extending over the entire length of the rope (1). In this case the cavity (3 )is filled by means of at least one resilient filling material or body, resilient at least as viewed in the radial direction of the rope (1), and which, when the rope (1) is pulled over an edge and with a high tensile force for example, results in a considerable momentary flattening of the cross-section of the rope when pulled over the edge and thus a considerably wider support of the rope (1) on such an edge. In addition, the rope core (2) is surrounded by a rope sheathing (4) provided with a protective layer (5) impervious to particles of dirt.

12 Claims, 2 Drawing Sheets

SAFETY MOUNTAINEERING ROPE

BACKGROUND OF THE INVENTION

The invention relates to a safety mountaineering rope with a core comprising a plurality of core ropes.

BRIEF SUMMARY OF THE INVENTION

The most frequent rope tears occur at sharp edges (on sharp-edged rocks in mountaineering for example) or, on the other hand, in loops with a small radius (for example in knots). This can be explained firstly by the fact that the rope material is not sufficiently cutting-resistant or excessive point forces act upon the cutting point, and secondly by the fact that the part of the rope remote from the edge or the part of the rope situated on the outside in the case of a knot is stretched to a considerably greater extent than the part of the rope resting on the edge or situated on the inside in the case of a knot. In the more greatly stretched outer curve of the rope the breaking elongation is thus exceeded earlier than in the part of the rope curve situated on the inside. Since only part of the support members present in the rope (fibres, yarns, twisted threads, plaits) are stressed to the breaking elongation at the moment of the rope tear, the tearing force measured in practice in the case of the ropes known hitherto is considerably smaller than what is possible theoretically. The latter can be calculated as the sum of the tearing forces of the individual support members, while taking into consideration the geometrical arrangement thereof.

The object of the present invention is to provide a safety mountaineering rope which does not have the aforesaid drawbacks of conventional ropes, i.e. in which with the same proportion of materials a considerably improved tearing resistance is achieved, and this is retained even after prolonged use of the mountaineering rope in an environment in which the said mountaineering rope is heavily soiled.

This object is attained by means of a mountaineering rope according to claim 1.

Advantageous further embodiments of the mountaineering rope according to the invention form the subject matter of the dependent claims 2 to 9.

BRIEF DESCRIPTION OF THE SEVERAL VIEW OF THE DRAWING

In the case of the rope according to the invention one or more cavities, which are filled with a compressible filling material or filling body, are formed in the interior, so that the rope can become flattened to an extreme degree at edges and in knots and can adapt to the rock situated thereunder. In this way, in the first place the distribution of pressure between the rope and the edge is made uniform, i.e. peaks of pressure are reduced, and secondly the elongation in the outer curve of the rope is reduced, so that the breaking elongation of the outermost layers in the curve of the rope is reached only at a later moment when additional support members of the rope are stressed up to the breaking elongation. In this case, a rope sheathing, which is provided with a protective layer impervious to dirt and water and which surrounds the rope core comprising a plurality of core ropes, ensures that even after prolonged use of this mountaineering rope no soiling of the rope core can take place even in a heavily soiling environment, as a result of which the internal flexibility of the mountaineering rope and thus the tearing resistance and the edge tearing resistance are retained in full.

The invention is explained below by way of example with reference to the drawing, in which FIG. 1 is a perspective view on a larger scale of an embodiment by way of example of a mountaineering rope according to the invention with a cross-section opened out for better visibility;

FIG. 2 is a cross-section through the mountaineering rope illustrated in FIG. 1, and FIG. 3 is an external view of a portion of the mountaineering rope illustrated in FIGS. 1 and 2.

DETAILED DESCRIPTION OF THE INVENTION

Figure 1:
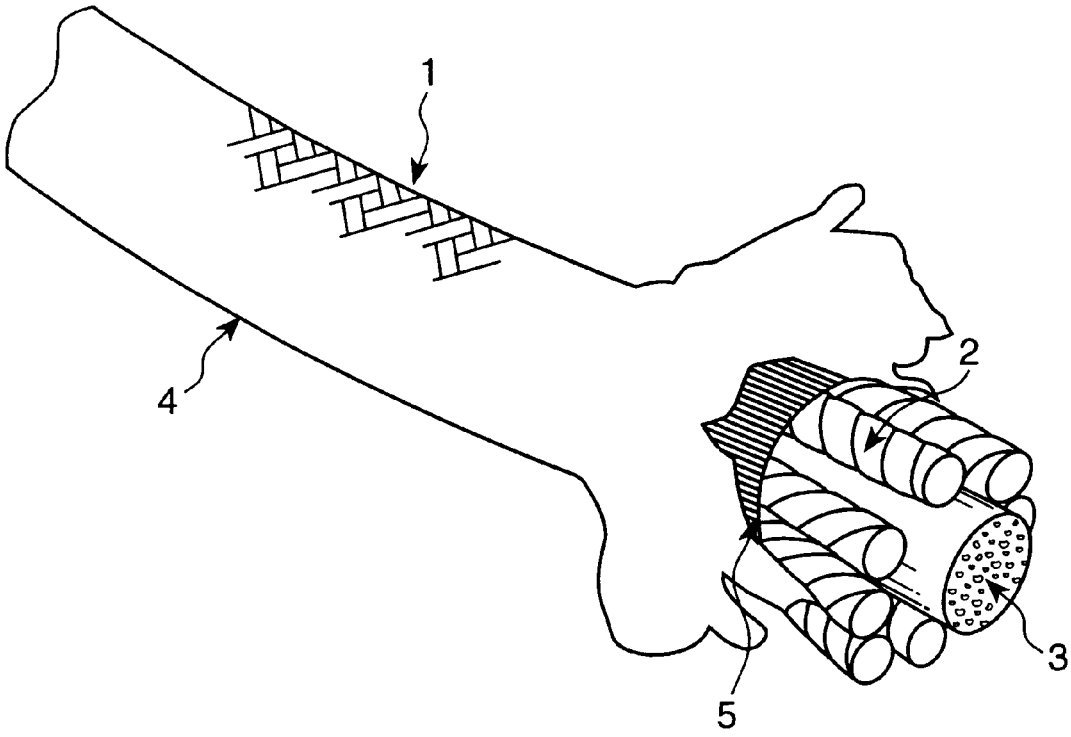
Figure 2:
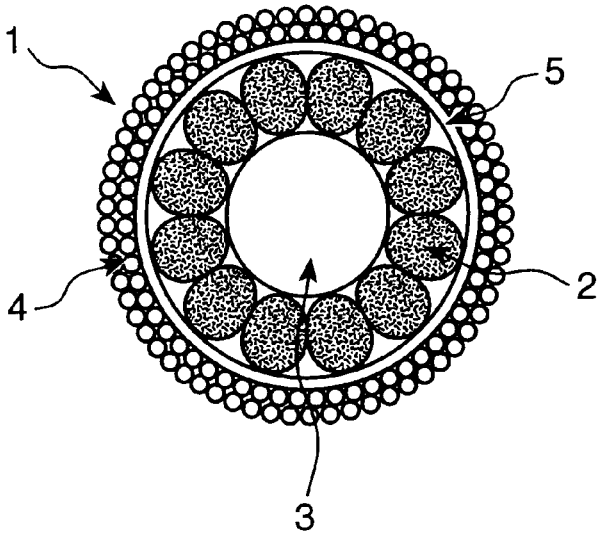

As is evident from the drawing, the mountaineering rope 1 illustrated has a core comprising a plurality of core ropes 2, the core ropes 2 consisting of synthetic fibres, for example twisted or plaited polyamide fibres.

The said rope core comprises a cavity 3 in the manner of a tube, which extends over the entire length of the rope 1.

In the embodiment illustrated the said cavity 3 is filled or supported by means of foam in a resilient manner.

In this case, the entire rope core is surrounded in a known manner by a sheathing 4 which consists for example of plaited material, the said sheathing 4 being provided on the inside thereof with a protective layer 5 which consists for example of polyurethane or silicone elastomer and which is impervious to particles of dirt.

The compressibility of the cavity 3 or the filling body situated therein is selected in such a way that the desired decrease in the volume thereof occurs only at the moment at which the rope is already highly stressed. The hollow rope 1 also has a greater degree of strength with respect to a normal rope tear (not an edge tear or a knot tear) than a conventional rope. In the first place, immediately in front of the tear the support members of the rope core are heavily compressed by radial forces starting from the sheathing 4. In this way, the mutual displacement of the individual support members and thus the desired load compensation is considerably obstructed. As a result of the compressible cavity of the hollow rope which yields or gives way to pressure, however, space is created inside the sheathing 4, so that the individual support members 2 of the rope (fibres, yarns, twisted threads, plaits) can be mutually displaced more easily. As a result, the breaking elongation and the breaking load are increased. Secondly, the support members in the sheathing 4 and the core 2 of the rope 1, which for example form a 45° angle with the longitudinal axis of the rope in the state of rest of the rope can be better orientated in the direction of the longitudinal axis of the rope when the volume of the rope core is reduced. As a result, the tearing strength of the rope 1 is increased, and in fact particularly strongly at the point at which the rope in question is to be torn, i.e. the rope 1 is strengthened at an incipient tearing point itself.

The increase in the energy absorption of the rope 1 as compared with conventional rope designs corresponds to the compression effort of the compressible cavity 3.

It is known from practice that the ageing of a rope is primarily dependent upon the degree of soiling. A new mountaineering rope, which for example can absorb 8 standard drops in accordance with the UIAA, can withstand only 2 to 3 standard drops after a few days of intensive use in mountains or in rock-climbing walls.

Larger and smaller particles of dirt, which have penetrated through the (generally plaited) sheathing 4 into the core of the rope, have the result that the individual support members of the rope (fibres, yarns, twisted threads, plaits) cannot be displaced relative to one another in front of the tear in the rope to a sufficient extent to distribute the load uniformly to the individual support members. At the moment of the tear in the rope the load is thus distributed to only part of the support members available, which has the result that the actual breaking strength of the rope is much smaller than what is possible theoretically.

In order to delay the ageing of the rope to a considerable degree, the rope according to the invention is designed in such a way that a layer 5 (for example of polyurethane), which is impervious to particles of dirt and which protects the inner support members 2 of the rope 1 from soiling, is fitted on, in or under the rope sheathing 4.

In order to increase the edge tear resistance of a rope 1, a cutting-resistant fibre (such as for example Dyneeman® or Kevlar®), which make it considerable more difficult to cut through the sheathing, can be additionally incorporated in the sheathing 4 of the rope according to the invention. Since the breaking elongation of cutting-resistant fibres is considerably less—because of the high degree of orientation of the molecules—than that of the rest of the rope material, the cutting-resistant fibre, for example mixed with a soft fibre such as a polyamide fibre, is used in the form of a highly twisted thread or, on the other hand, in a textured form.

During mountain climbing the rope is frequently "climbed out", i.e. is used over the entire length thereof. In order to ascertain whether the next good hold can be reached, the leading climber is constantly asking the belaying climber about the length of rope still available. If the rope is calibrated in a double-meter measure for example, i.e. is provided with suitable markings, the length of rope still available can be indicated with a high degree of accuracy. Such a "longitudinal calibration" affords the additional advantage that the rope 1 can be tested for possible over-extension at any time with reference to these markings.

Figure 3:
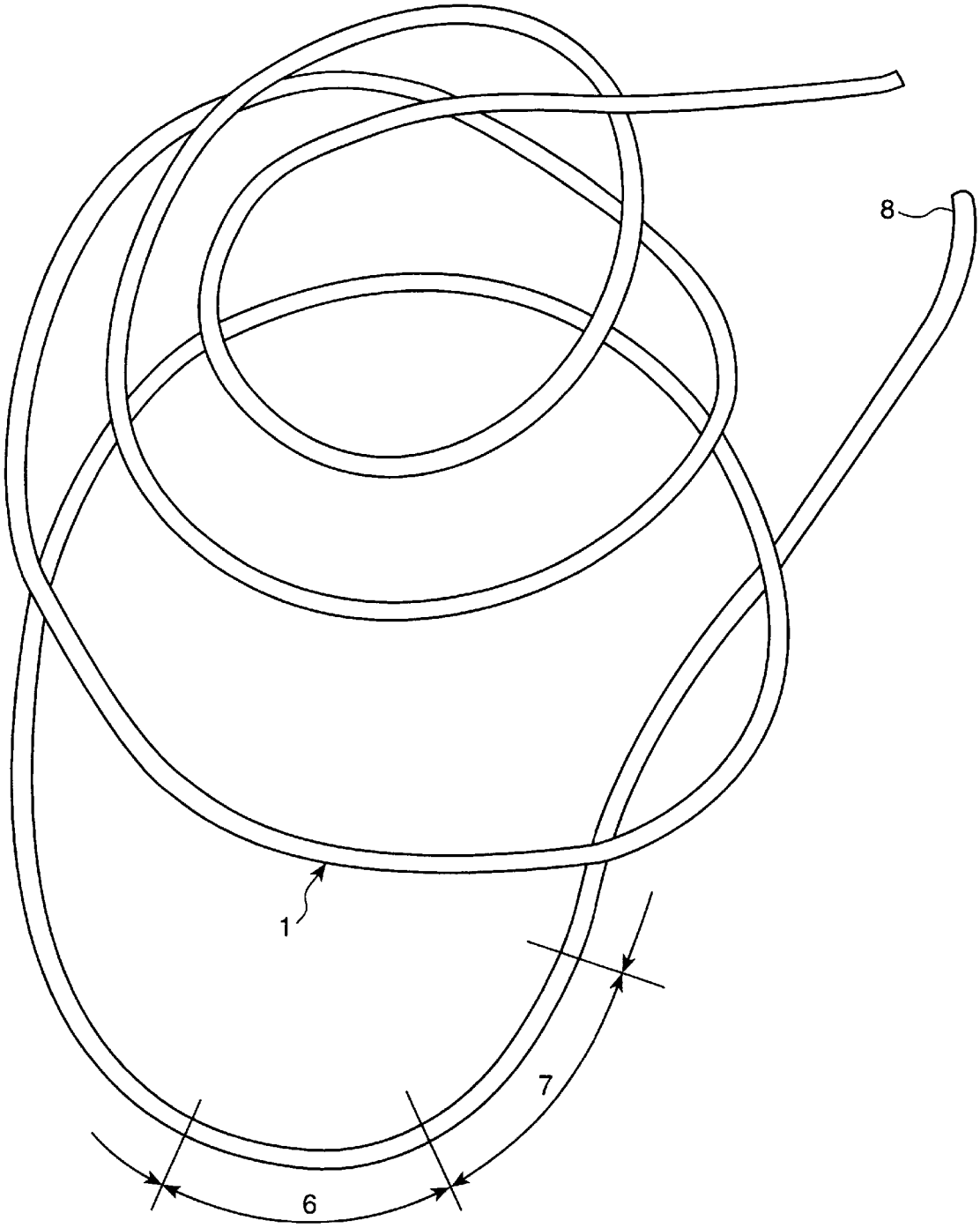

In the case of the rope 1 according to the invention the longitudinal dimension of the rope can be indicated by colour in the manner of a register, in that for example differently coloured longitudinal areas 6 and 7 (vide FIG. 3) following alternately in succession and each of 1 or 2 m in length for example can be provided.

Furthermore, an avalanche-seeking probe 8, for example in accordance with the successful RECCO® system, can be inserted in the rope 1 as an addition at the beginning and end of the said rope for example. A person is always present at these points.

As yet there is no rope, the state of which with respect to the action of dirt, over-extension, exposure to light, action of heat etc., can be read off reliably with reference to a scale.

In the case of the rope according to the invention, suitable indicators can be incorporated, the visual changes of which indicate the state of the rope. These indicators can include: a) dirt: a sheathing yarn in a bright, brilliant color or white; b) over-extension: a sheathing color on the surface, which, in the event of irreversible stretching, allows a non-tinted sheathing or core material to show through, or profiled fibers which change the light reflection in the event of irreversible stretching; c) exposure to light: a sheathing which contains a dye with a low light-fastness; and d) over-heating: a sheathing yarn colored with a thermotropic dye, as used for example in heat-sensitive paper.

These changes can be quantified with reference to a scale which is supplied. This allows the rope to be withdrawn from service before the nominal values can no longer be met.

What is claimed is:

1. A safety mountaineering rope with a core comprising a plurality of core ropes (2), wherein said core ropes surround at least one region (3) extending over the entire length of the mountaineering rope (1), and said mountaineering rope further comprises at least one resilient filling material or body filling the region (3), and a rope sheathing (4) surrounding said core ropes, said sheathing including a protective layer (5) which is impervious to particles of dirt, and further wherein, as viewed in the radial direction of the mountaineering rope (1), the resilient deformability of the filling material or body is at least 30% greater at a specified radial force than that of the material of the core rope.

2. A mountaineering rope according to claim 1, characterized in that the region (3) is filled by means of foam or at least one resilient tube extending in the longitudinal direction of the rope.

3. A mountaineering rope according to claim 1, characterized in that the protective layer (5) consists of polyurethane or silicone elastomer.

4. A mountaineering rope according to claim 1, characterized in that the rope sheathing (4) is formed at least in part by a cutting-resistant material, in such a way that the longitudinal extensibility of the rope sheathing (4) is at least as great as the longitudinal extensibility of the core ropes (2).

5. A mountaineering rope according to claim 4, wherein the cutting-resistant material is an aromatic polyamide fiber.

6. A mountaineering rope according to claim 1, characterized in that the outside of the mountaineering rope is provided over the entire length thereof at regular intervals, with markings or marked areas (6, 7) extending along its outer periphery.

7. A mountaineering rope according to claim 6, wherein the regular intervals are two-meter intervals.

8. A mountaineering rope according to claim 2, characterized in that it is provided with indicators at least one of the following aging factors a) dirt: sheathing yarn in a bright, brilliant color or white;

b) over-extension: a sheathing color on the surface, which, in the event of irreversible stretching, allows a non-tinted sheathing or core material to show through, or profiled fibers which change the light reflection in the event of irreversible stretching;

c) exposure to light: a sheathing yearn which contains a dye with a low light-fastness; and d) over-heating: a sheathing yarn colored with a thermotropic dye, as used for example in heat-sensitive paper.

9. A mountaineering rope according to claim 1, characterized in that the cross-sectional area of the region amounts to from 4 to 50%, of the entire cross-sectional area of the mountaineering rope.

10. A mountaineering rope according to claim 9, wherein the cross-sectional area of the region amounts to from 20 to 35% of the entire cross-sectional area of the mountaineering rope.

11. A safety mountaineering rope with a core comprising a plurality of core ropes (2), wherein said core ropes surround at least one region (3) extending over the entire length of the mountaineering rope (1), and said mountaineering rope further comprises at least one resilient filling material or body filling the region (3), and a rope sheathing (4) surrounding said core ropes, said sheathing including a protective layer (5) which is impervious to particles of dirt, and further wherein said mountaineering rope is provided with incorporated avalanche-seeking probes (8).

12. A mountaineering rope according to claim 11, wherein the avalanche-seeking probes are provided at the beginning and the end of the mountaineering rope.

* * * * *